US007303370B2

(12) United States Patent
Metz et al.

(10) Patent No.: US 7,303,370 B2
(45) Date of Patent: Dec. 4, 2007

(54) FLUID FLOW ENGINE AND METHOD OF PRODUCING A GUIDING GRID

(75) Inventors: Dietmar Metz, Meckhenheim (DE); Dirk Frankenstein, Worms (DE); Ralf Boening, Reiffelbach (DE)

(73) Assignee: BorgWarner, Inc., Auburn Hills, MI (US)

( * ) Notice: Subject to any disclaimer, the term of this patent is extended or adjusted under 35 U.S.C. 154(b) by 63 days.

(21) Appl. No.: 10/974,321

(22) Filed: Oct. 27, 2004

(65) Prior Publication Data

US 2005/0169748 A1 Aug. 4, 2005

(30) Foreign Application Priority Data

Oct. 27, 2003 (EP) ..... 03024662

(51) Int. Cl.
*F01D 17/12* (2006.01)

(52) U.S. Cl. ..... 415/150; 415/160; 415/165

(58) Field of Classification Search ..... 415/159–165, 415/150; 29/464, 469, 525.14, 889.2
See application file for complete search history.

(56) References Cited

U.S. PATENT DOCUMENTS

| | | | | |
|---|---|---|---|---|
| 3,645,645 A | | 2/1972 | Gammill et al. | |
| 4,659,295 A | | 4/1987 | Burdette et al. | |
| 4,702,672 A | | 10/1987 | Leicht et al. | |
| 4,820,118 A | * | 4/1989 | Yano et al. | 415/161 |
| 5,207,565 A | | 5/1993 | Roessler | |
| 5,749,670 A | * | 5/1998 | Astor | 29/525.14 |
| 6,312,217 B1 | | 11/2001 | Takahashi | |
| 6,409,483 B2 | * | 6/2002 | Jinnai | 415/160 |
| 6,543,994 B2 | * | 4/2003 | Jinnai | 415/160 |
| 6,916,153 B2 | * | 7/2005 | Boening | 415/163 |

FOREIGN PATENT DOCUMENTS

| | | |
|---|---|---|
| EP | 0 226 444 A | 6/1987 |
| EP | 1 099 838 A | 5/2001 |
| EP | 1 120 546 A | 8/2001 |
| JP | 60 169604 A | 9/1985 |

* cited by examiner

*Primary Examiner*—Edward K. Look
*Assistant Examiner*—Devin Hanan
(74) *Attorney, Agent, or Firm*—Stephan A. Pendorf; Akerman Senterfitt

(57) ABSTRACT

A fluid flow engine comprises: a turbine housing including at least one supply channel for supplying a driving fluid; at least one turbine rotor rotatably supported in the turbine housing about an axis of rotation; and a guiding grid of variable turbine geometry radially outside and surrounding the turbine rotor. The guiding grid comprises a nozzle ring forming one end limitation of a vane space and a plurality of guiding vanes each being pivoted about a pivoting axis and being supported by the nozzle ring so as to supply an adjustable amount of fluid from the supply channel to the turbine rotor. At least one spacer is connected to the nozzle ring for securing an axial distance for enabling the vanes to wove freely. The spacer includes at least one bolt or pin tat penetrates into the nozzle ring. This bolt or pin forms itself the spacer by inserting one end of it between the nozzle ring and a part in the turbine housing, while it is fixed to the axial distance of the vane space at the other end by a connection material which may be applied in molten condition, but is then temperature resistant.

8 Claims, 2 Drawing Sheets

FLUID FLOW ENGINE AND METHOD OF PRODUCING A GUIDING GRID

FIELD OF THE INVENTION

This invention relates to a fluid flow engine, such as a turbine or a secondary air pump, but particularly to a turbocharger. In detail, a fluid flow engine is provided comprising a turbine housing having at least one supply channel for supplying a driving fluid, such as waste gas of a combustion motor, wherein at least one turbine rotor is rotatably supported about an axis of rotation, the fluid being supplied to this rotor through a guiding grid of variable geometry, that surrounds the exterior of the turbine rotor. This guiding grid comprises a nozzle ring which supports a plurality of guiding vanes, the position of each of which being adjustable about a pivoting axis and being located in an axially limited vane space around the turbine rotor. Thus, an adjustable amount of waste gas may be supplied through the guiding vanes. The nozzle ring forms one axial limitation of the vane space. There is a spacer device for ensuring an axial distance so as to enable free movement of the guiding vanes, the spacer device including at least one bolt, pin or the like penetrating the nozzle ring.

BACKGROUND OF THE INVENTION

Such a turbocharger and such a nozzle ring has become known, for example, from EP-A-0 226 444 or U.S. Pat. No. 5,146,752. In these constructions, the axial dimension of the vane space is ensured by spacing distance sockets overdrawn over screw bolts, the sockets, of course, possessing an outer diameter which exceeds distinctively that of the bolts. In an older patent application, assigned to the assignee of the present application, it has been suggested to form spacers, e.g. in the form of burls, integrally with a ring, each one of these spacers being penetrated by a bolt.

SUMMARY OF THE INVENTION

The present invention, in a first step, starts from the recognition that the efficiency of a fluid flow engine depends, of course, on a conversion as high as possible of the energy contained in the fluid into revolutions of the turbine wheel. Therefore, every disturbance or every resistance within the path of flow must necessarily reduce the efficiency in an undesirable way. On the basis of this recognition, the inventors investigated in a further step how the flow in such an engine could be improved. When doing this, it turned out that the distance sockets or burls, both being overdrawn over a bolt, which are situated around the turbine rotor and particularly in the connecting path between the supply channel and the turbine rotor, cause a relative considerable development of turbulence which provokes a decrease of efficiency.

According to the invention, the problem, thus determined, is solved in that the respective bolt or pin or the like itself is formed as a spacer device by inserting one end between the nozzle ring and a part provided in the turbine housing, while it is fixed to the axial distance of the vane space at the other end by means of a connection material which may be applied in molten condition, but is then temperature resistant. In this manner, it is only the diameter of the bolt or pin which is in the connecting path of the fluid towards the turbine rotor, i.e. there will be a substantially reduced flow resistance as compared with the prior art. In short, the invention consists in the use of the bolt or pin itself as a spacer device without a thickening casing around. As "temperature resistant", a material should be understood within the context of this invention which does not lose the necessary strength at temperatures occurring during operation of a fluid flow engine and particularly of a turbocharger.

The material to be applied in molten condition but being then temperature resistant may, in principle, be a soldering material, because there are soldering materials which even resist the temperatures of a turbocharger (there is, of course, no problem in fluid flow engines which are operated at lower operating temperatures). However, it is generally preferred, if the fixation of the distance is made by welding.

Certainly, it would be possible to solder or weld the respective bolt at its two ends. However, it is preferred, if one end of the bolt, pin or the like comprises a thread for screwing, while it is only the other end which is fixed by means of the connection material. It should particularly noted that the one-sided connection by means of the molten connection material will also provide security against rotation of the respective bolt.

In principle, the part provided in the turbine housing may be a wall of the turbine housing itself. However, it is preferred if it is formed by a mounting ring situated opposite the nozzle ring and being axially spaced from it by the width of the vane space, because in this way pre-mounting the guiding grid outside the turbine housing can be effected so that the pre-mounted guiding grid needs only to be fastened inside the turbine housing.

It is, for example, possible within the scope of the present invention to insert the bolt or pin from the side of the part of the turbine housing, i.e. from the side of the housing wall or the mounting ring, and then to fix it to the nozzle ring by means of the connection material (in this case, it will generally be a soldering material). However, it is preferred, if the bolt, pin or the like is screwed into the nozzle ring, and is fixed at the opposite end by means of the connection material to be applied in molten condition, but which is then temperature resistant.

In order to reduce flow resistance further, it is possible within the scope of the present invention that the bolt, pin or the like, at least over the length passing through the vane space, has a cross-section of flow pointing at least approximately towards the axis of rotation, i.e., for example, a streamlined profile similar to that of the body of an airplane or a ship.

As has been mentioned above, the present invention relates also to a method of producing a guiding grid for a fluid flow engine according to the invention. This method is characterized in that at least one, optionally removable, spacer is inserted between the nozzle ring and the part provided in the turbine housing, the length of the spacer corresponding to the desired nominal distance, that the bolt, pin or the like is only then fixed at the predetermined distance, whereupon the spacer(s) is (are) removed, if necessary.

BRIEF DESCRIPTION OF THE DRAWINGS

Further details will become apparent from the following description of preferred embodiments schematically illustrated in the drawings, in which.

DETAILED DESCRIPTION OF THE DRAWINGS

Figure 1:
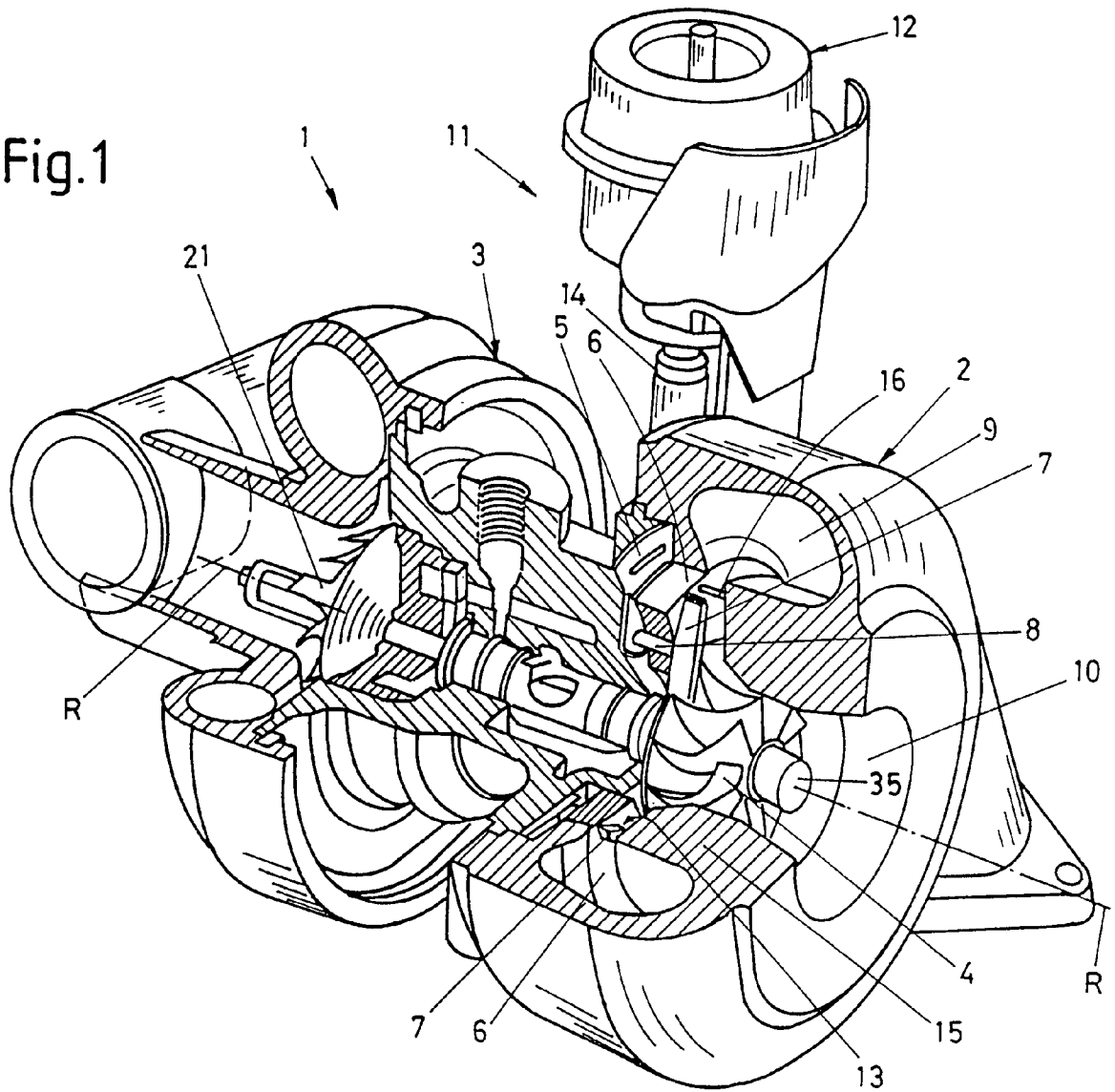
FIG. 1 is a turbocharger in a perspective view, partially in cross-section, where the present invention is applied.

According to FIG. 1, a turbocharger 1 comprises a turbine housing part 2, as usual, and a compressor housing part 3 connected to it, the housings being arranged along an axis of rotation R. The turbine housing part 2 is partially shown in cross-section so that a nozzle ring 6 is shown which forms a radial outer guiding grid by guiding vanes 7 distributed over its circumference. These guiding vanes 7 may be pivoted about pivot shafts 8 supported by the nozzle ring 6 so that they form nozzle cross-sections which, according to the pivot position of the vanes 7, i.e. either more radial (as shown) or more tangential, are larger or smaller so as to supply more or less waste gas of a combustion motor to a centrally located turbine rotor 4 at the axis R, the waste gas being supplied through a supply channel 9 and being discharged through a central channel 10 to drive a compressor rotor 21 by the turbine rotor 4 which are mounted both on the same shaft. It will be understood that in the case of a different fluid flow engine, other fluids may be used.

In order to control the pivoting movement and the position of the guiding vanes 7, an actuation device 11 is provided. This device may be of any nature, but it is preferred, if it comprises in a traditional way a control housing 12 which controls the control movement of a tappet element 14 whose movement is converted in a slight rotational movement of a unison ring 5 situated, as known per se, behind the nozzle ring 6 (at left behind in FIG. 1). By this rotational movement, the pivot positions of the shafts 8 of the guiding vanes 7 are adjusted relative to the turbine rotor 4 in such a way that they are displaced from an about tangentially extending extreme position into an about radially extending other extreme position. In this way, a greater or smaller amount of waste gas of a combustion motor, supplied through the supply channel 9, is fed to the turbine rotor 4 prior to being discharged through the axial channel 10 which extends along the axis of rotation R. It is also known (U.S. Pat. No. 4,300,869) to provide mere axles instead of shafts 8 transferring torque in order to effect adjustment of the pivot position of the guiding vanes 7 by slots or grooves.

There is a relative narrow space 13 between the nozzle ring 6 and an annular portion 15 of the turbine housing part 2 to permit free pivoting movement of the vanes 7. Of course, this vane space 13 should not be substantially larger than the axial width of the vanes 7, because otherwise the waste gas energy would suffer leakage losses. On the other hand, the vane space 13 should not be dimensioned too narrow, because otherwise the vanes 7 could get jammed. This is particularly of importance, because just in the case of a turbocharger one has to consider that a certain thermal expansion of the material will occur.

In order to ensure that this vane space 13 and the axial distance of the nozzle ring 6 from the opposite bearing ring 15 of the turbine housing 2 is maintained without being forced to accept a strong turbulence of the waste gas flowing from the supply channel 9 to the turbine rotor 4, a relative thin fastening bolt 16 is used, according to the invention, as a spacer whose manner of mounting will now be described with reference to FIG. 2.

Figure 2:
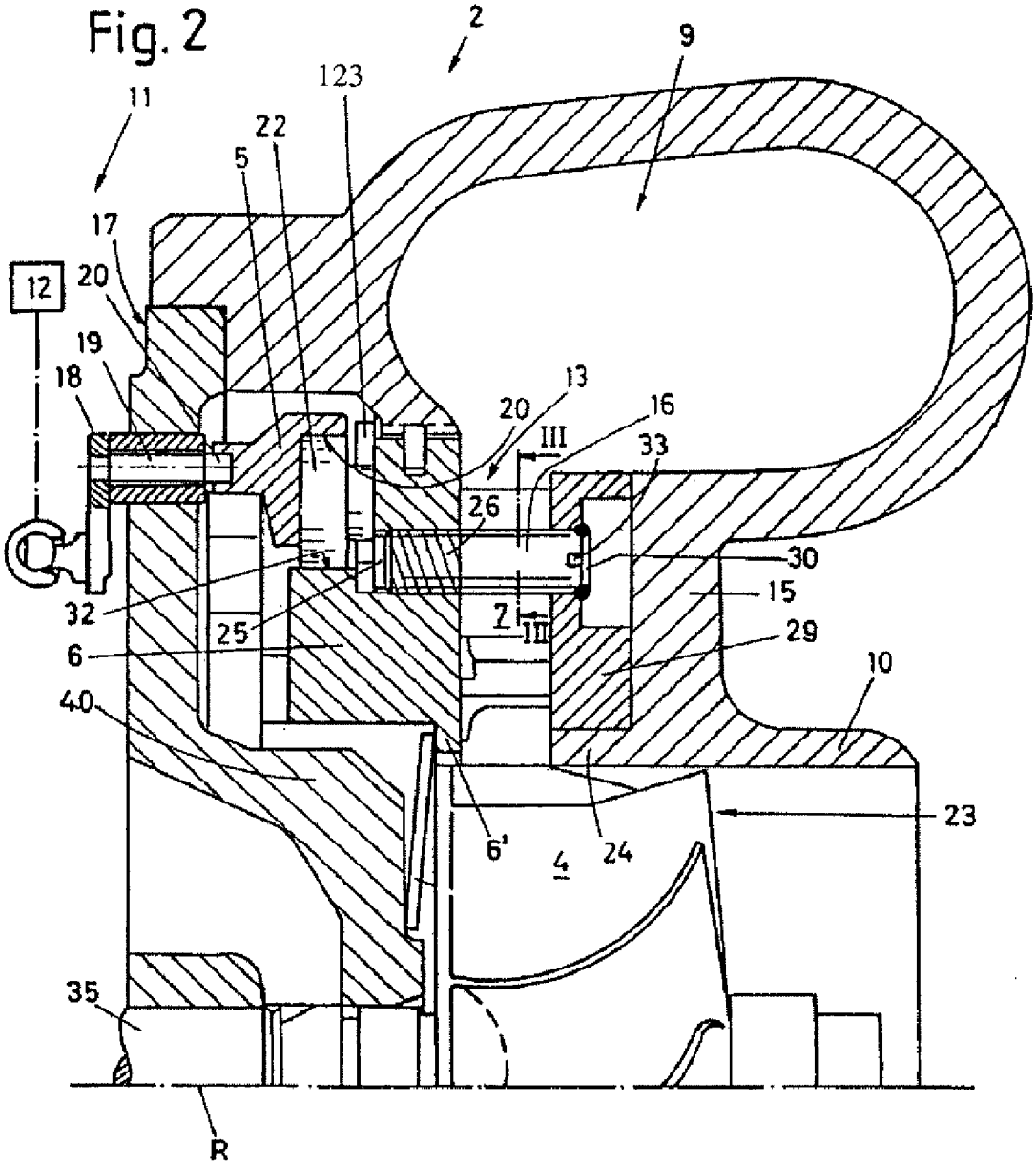
FIG. 2 is a cross-sectional view at a larger scale which illustrates the spacer device according to the invention.

According to FIG. 2, the turbine housing 2 is connected to a flange 17 of a bearing housing, a cylindrical portion 40 of which protruding into the turbine housing 2 and supporting the shaft 35 of the turbine rotor 4. The turbine housing 2 comprises the supply channel 9 for supplying the fluid which drives the turbine rotor 4, as has already been mentioned above, and which surrounds the turbine rotor 4, the rotor space 23 and the axial channel 10 through which the fluid is eventually discharged.

In order to supply a controlled amount of fluid to the turbine rotor 4, an arrangement is provided at the exit side of the supply channel 9 and before the rotor space 23 which is known to those skilled in the art under the term "guiding grid of variable geometry". This guiding grid comprises substantially a ring of moveable guiding vanes 7 concentrically surrounding the turbine rotor 4, which are accommodated in the vane space 13, and whose pivot shafts 8 fixed to them (vide FIG. 1) are supported by the nozzle ring 6 that surrounds coaxially the turbine rotor 4.

Turning and adjusting the pivot shafts 8 maybe effected in a manner known per se by the actuation device 11 (FIG. 1) including the control housing 12 which controls the control movement of the tappet element 14 (merely indicated in dash-dotted lines in FIG. 2) mounted to it. The movement of the tappet element 14 is converted into a small rotational movement of the unison ring 5, situated behind the nozzle ring 6, about the axis R by means of an actuation lever 18, an actuation shaft 19 fastened thereto and, for example, by an eccentric 20 engaging an opening of the unison ring 5. The heads or free ends of levers that are fastened to the pivot axes (in FIG. 1 at left of the shaft 8) may engage radial grooves of the unison ring 5.

By this rotational movement of the unison ring 5, the pivot position of the vanes 7 relative to the turbine rotor 4 is adjusted via the shafts 8 in such a way that they may be displaced from an about tangentially extending extreme pivot position into the other extreme position where they extend substantially in radial direction. In this way, a larger or smaller amount of waste gas of a combustion motor supplied through the supply channel 9 is fed to the turbine rotor 4 prior to exiting through the axial channel 10 extending along the rotational axis R. All these arrangement are generally known. The unison ring 5 may be born on a shoulder 32 of the nozzle ring by rollers 22 mounted on a cage ring 123 as corresponds to an older patent application assigned to the same assignee as of the present patent application.

It is advantageous, in order to secure the axial dimension (referring to the axis R) of the vane space 13, to interpose and to use a mounting ring 29, instead of limiting the vane space by the nozzle ring 6, on the one hand, and by the bearing ring 15 formed by the annular wall of the turbine housing 2. This mounting ring 29 may be placed, for example, on an annular shoulder 24 of the turbine housing or the bearing wall 15. In this manner, it is possible to pre-mount the nozzle ring 6 with the unison ring 5 riding thereon on one side plus the vanes 7 and the mounting ring 29 on the other side, and to insert it then (prior to mounting the bearing housing and its portion 40) into the turbine housing 2 and to the annular shoulder 24.

In order to secure the axial dimension (with respect to the axis R) of the vane space 13, it is advantageous during pre-mounting to screw a spacer screw 16 into a threaded bore 25 of the nozzle ring 6, suitably from the side of the mounting ring 29. The screw 16 is preferably a double-end stud, also known as worm screw and constituting a head-less screw or threaded pin. The penetration depth of the screw 16 into the bore 25 is not critical. The double-end stud 16 has preferably a smooth outer surface joining a threaded portion 26 (so as to be without any thread within the vane space 13)

in order to provide a flow resistance as small as possible. It is convenient to provide this outer surface of the double-end stud 16 with a roughness of a roughness number Rz of 25 in maximum, more preferably of 16 in maximum.

Subsequently, a removable spacer of the desired dimensions, e.g. a piece of wood of a corresponding thickness or any other body, is inserted so into the vane space 13 that the nominal width of the vane space 13 is determined in this way. Then, this distance is secured by soldering or (preferably) by welding the screw 16 by means of a weld seam 30, so that the screw is 16 also prevented from rotation at the same time, thus efficiently avoiding any undesired screwing off from the threaded bore 25 due to shaking and vibration. The spacer of wood or any other material may then be removed after the guiding grid and the guiding vanes 7 have been pre-mounted. Just when the guiding grid is pre-mounted and prior to inserting it into the turbine housing 2, soldering or welding automatics can easily be used for applying the softened connection material so that the method according to the invention can be carried out in a cost saving manner.

It will be understood that the arrangement could also be reversed by screwing the screw 16 into the mounting ring 29 and welding it, but preferably soldering it, to the nozzle ring 6. Furthermore, it would be possible to make the bolt 16 without any thread at all and to solder or weld it on both ends. In addition, it will be understood that one could also use sockets on the spacer screws 16, but in this case, they need not to absorb axial forces, because they are not used as spacers, and therefore, according to the invention, could be made thinner than in the prior art, i.e. with less flow resistance. In this latter case, there is no need for removable spacers during production. However, what has been explained above with reference to the roughness of the outer surface and the respective roughness numbers would preferably apply in such a case also to the thin socket.

Figure 3:
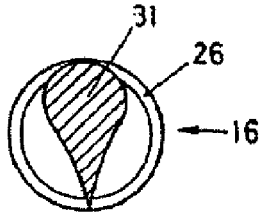
FIG. 3 is a still enlarged cross-sectional view according to the line III-III of FIG. 2, but showing a particular embodiment of a spacer bolt according to the invention.

An additional measure for improving the flow conditions from the supply channel 9 towards the rotor space 23 can consist in that the bolt, pin or the like 16 has a streamlined profile, at least over the length which passes through the vane space 13, the profile pointing at least approximately towards the axis of rotation R, as is illustrated in FIG. 3. Joining the circular threaded portion 26 of the screw 16, there is about a gutate streamlined profile 31 that points downwards (with reference to FIGS. 2 and 3) in the direction to the axis of rotation R. This design facilitates also a partial introduction of the weld seam 30 (FIG. 2) between the end portion of the bolt 16 and the inner surface of the bore of the mounting ring 29, which receives the bolt. The streamlined profile can be optimized as desired, such as is known from ship construction or airplane construction, for example by sharpening more or less also the upper side of the bolt 16.

In each case, it will be understood that by using only a bolt (or screw or pin or the like) instead of a casing for securing the distance, the flow resistance will be reduced. In principle, it would be sufficient to secure the distance only in the region of the orifice of the supply channel 9 in the manner according to the invention, whereas all other spacers could be traditional, but it will be understood that it is preferred to secure the distance over the whole circumference of the nozzle ring 6 opposite the mounting ring 29 or a bearing ring 15 formed by a wall of the turbine housing 2 (FIG. 1) in the manner described above.

In FIG. 2, a double-end stud 16 has been shown as a spacer bolt where a screwing slot 33 is provided at the end of the screw 16 opposite the threaded portion 26. Of course, this is not necessarily so; it would also be possible to provide the screwing slot 33 at the same end. Instead of a double-end stud 16, a cap screw could also be used, but in this case applying the weld seam 30 would become more difficult or inefficient.

It is also clear that a plurality of supply channels and/or turbine rotors can be used as is known per se. The bolt (16) or the like can comprise at least one threaded portion (26) for a screw connection, at one end, while only the other end is fixed by the connection material (30). The bolt (16) or the like can have a smooth outer surface at least over the length passing through the vane space, for example with a roughness number of 25 in maximum, more preferably of 16 in maximum and/or a streamlined profile pointing at least approximately towards the axis of rotation.

What is claimed is:

1. A fluid flow engine comprising:

a turbine housing having a supply channel for a fluid and a mounting shoulder;

a turbine rotor rotatably supported in the turbine housing and in fluid communication with the supply channel;

a guiding grid being of variable geometry, the fluid being supplied through the guiding grid to the turbine rotor, the guiding grid comprising a nozzle ring having a number of vanes, each of the number of vanes having an axle, the number of vanes being positioned along the nozzle ring in a vane space and radially outward of the turbine rotor, the fluid being supplied through the number of vanes in adjustable quantity via the variable geometry, the nozzle ring forming an axial limitation of the vane space and having at least one bolt crossing the vane space, the at least one bolt maintaining an axial distance in the vane space for free movement of the number of vanes; and a mounting ring positioned opposite the nozzle ring, wherein the mounting ring rests on the mounting shoulder of the turbine housing, wherein the at least one bolt is inserted between the nozzle ring and the mounting ring and is affixed across the axial distance of the vane space by a connection material which was applied to at least one of the nozzle ring or the mounting ring in molten condition and became temperature-stable thereafter, and wherein the at least one bolt has a smooth outer surface at least over the length passing through the vane space.

2. The fluid flow engine of claim 1, wherein the at least one bolt comprises a first end having a threaded portion connected to the nozzle ring and a second end being fixed only by the connection material to the mounting ring.

3. The fluid flow engine of claim 1, wherein the mounting shoulder of the turbine housing is an annular shoulder and the mounting ring rests on a radial outer portion of the mounting shoulder.

4. The fluid flow engine of claim 1, further comprising a compressor rotor connected to a shaft of the turbine rotor.

5. The fluid flow engine of claim 1, wherein the axial distance is fixed by welding.

6. The fluid flow engine of claim 1, wherein the at least one bolt comprises a first end having a threaded portion and a second end being fixed by the connection material only.

7. The fluid flow engine of claim 1, wherein the at least one bolt comprises a double-end stud.

8. The fluid flow engine of claim 1, wherein the smooth outer surface of the at least one bolt has a roughness number of less than 25.

* * * * *